US006212689B1

(12) United States Patent
Lee

(10) Patent No.: US 6,212,689 B1
(45) Date of Patent: Apr. 10, 2001

(54) COMPOUND PROTECTIVE HELMET

(75) Inventor: Te-Lung Lee, Tainan Hsien (TW)

(73) Assignee: Lung Huei Safety Helmet Co., Ltd., Tainan Hsien (TW)

( * ) Notice: Subject to any disclaimer, the term of this patent is extended or adjusted under 35 U.S.C. 154(b) by 0 days.

(21) Appl. No.: 09/425,137

(22) Filed: Oct. 21, 1999

(51) Int. Cl.[7] ..... A42B 3/18
(52) U.S. Cl. ..... 2/424
(58) Field of Search ..... 2/410, 411, 422, 2/423, 424, 425, 6.3, 6.5, 6.7, 10

(56) References Cited

U.S. PATENT DOCUMENTS 4,689,836 * 9/1987 Vitaloni ..... 2/424
4,766,615 * 8/1988 Morin et al. ..... 2/421
4,769,857 * 9/1988 Cianfanelli et al. ..... 2/424
4,794,652 * 1/1989 Planta et al. ..... 2/414
5,084,918 * 2/1992 Breining et al. ..... 2/424
5,301,372 * 4/1994 Matoba ..... 2/424
5,412,810 * 5/1995 Taniuchi ..... 2/424
5,444,875 * 8/1995 Taniuchi ..... 2/424

* cited by examiner

*Primary Examiner*—Michael A. Neas
(74) *Attorney, Agent, or Firm*—Pro-Techtor International Services

(57) ABSTRACT

A compound protective helmet that allows easy and reliable operation of the visor. The helmet includes a bubble, a visor pivoted to the bubble, and a chin protector. A pad is provided between the bubble and the visor to allow two-stage lifting of the visor. A securing and release device is fixed in the chin protector, and includes two securing levers that are driven by a leading block and are held against a resilient element so as to be secured in grooves provided in the ear protector on both sides of the bubble. If a user wants to raise the visor, the pusher block is pushed to cause the securing levers to disengage from the grooves while lifting the visor.

7 Claims, 13 Drawing Sheets

COMPOUND PROTECTIVE HELMET

BACKGROUND OF THE INVENTION

1. Field of the Invention

The present invention relates to a compound protective helmet, and more particularly, to one that allows reliable visor lift operation, and firm securing of the visor when closed.

2. Description of the Prior Art

In the prior art, a chin protector is formed in front of the bubble of a protective helmet, and a window framed with a visor is provided above the chin protector. FIGS. 1 through 4 of the accompanying drawings show the structure and visor operation of the prior art. Referring to FIGS. 1, 2, and 3, the prior art helmet comprises a bubble 10, a visor 20, and a chin protector 30 are pivoted to the bubble 10. A securing and release device 40 is fixed at the inner edge of the chin protector 30 to provide a full mask protective helmet by having the securing and release 40 secured in the grooves 101 provided at both sides of the bubble 10. The securing and release device 40 is comprised of two hooks 401 linked with a cable 402. The cable 402 is connected to a press member 403 and a resilient element 404 that presses against the press handle 403. Therefore, when said hooks 401 of the securing and release device 40 are secured in the grooves 101 of the bubble, the protective helmet is a full mask. To lift the visor 20, the press member 403 is pressed to pull the cables 402, in turn, the hooks 401 disengage from the grooves as illustrated in FIG. 3.

Now referring to FIG. 4, once the hooks 401 clear the grooves 101, the chin protector 30 and the visor 20 are lifted up to a certain point to form a semi-mask protective helmet. To restore to full mask as illustrated in FIG. 1, the chin protector is pulled down to let the hooks slide along the bubble 10 to fall into the grooves 101 and to be secured there. Though the prior art gives the advantage of easy conversion between full and semi mask protective helmet, the following defects in terms of its structural design and practical use are found.

1. Poor securing effects. Since the securing of both the chin protector and the bubble depends on the engagement of the hooks into the grooves provided on the bubble, in practice, the hooks tend to slip away and disengage from the grooves when even a mild force is applied to lift the chin protector.

2. Visor must be lifted in two steps. To lift the visor, a user must first press the press member to release the chin protector before pushing up the chin protector.

DETAILED DESCRIPTION OF THE INVENTION

Figures 1, 3:
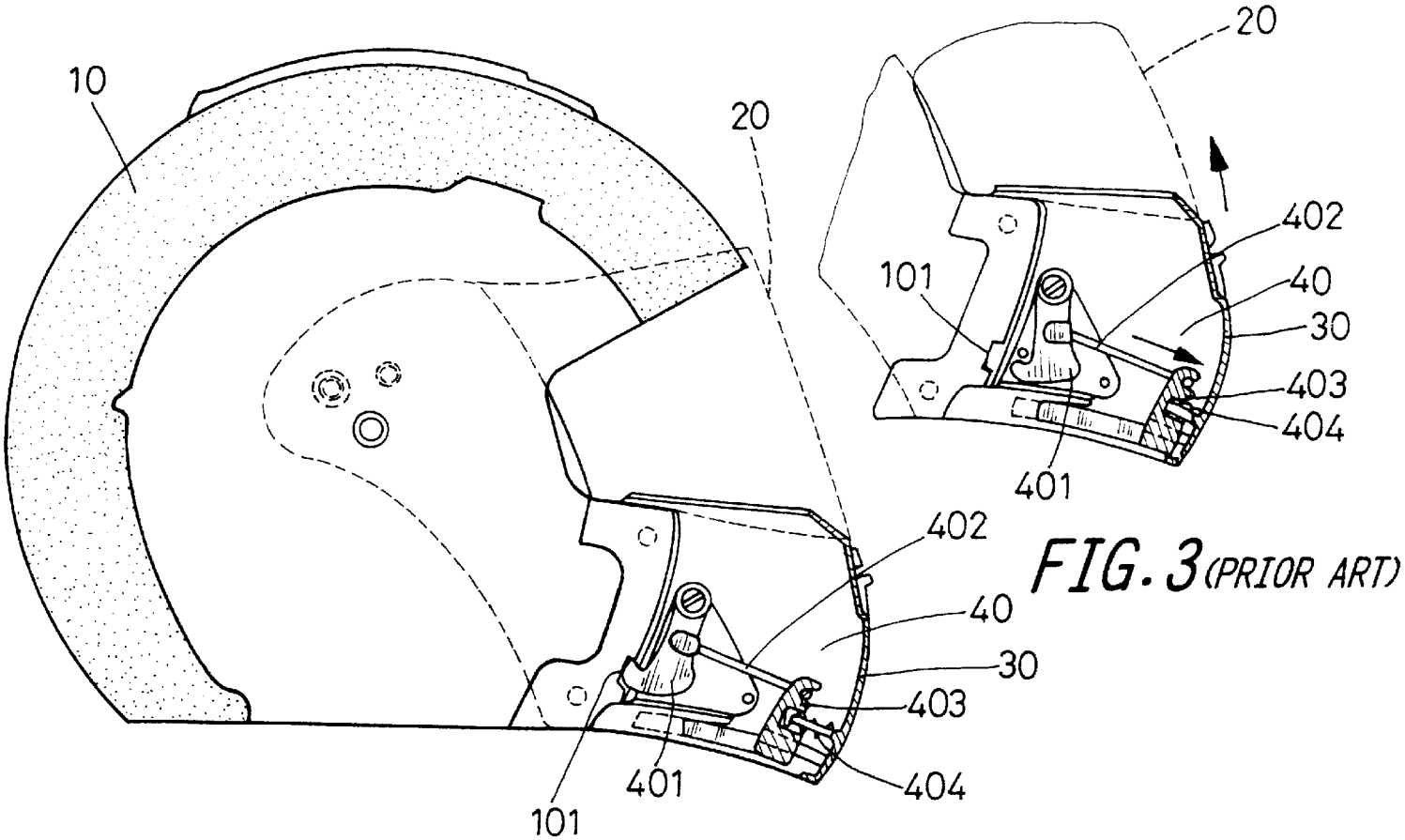
FIG. 3 (PRIOR ART)
FIG. 1 (PRIOR ART)
FIG. 1 is a sectional view of a compound, full mask protective helmet of the prior art.
FIG. 3 is a schematic view showing the operation of a compound protective helmet of the prior art.
Figure 2:
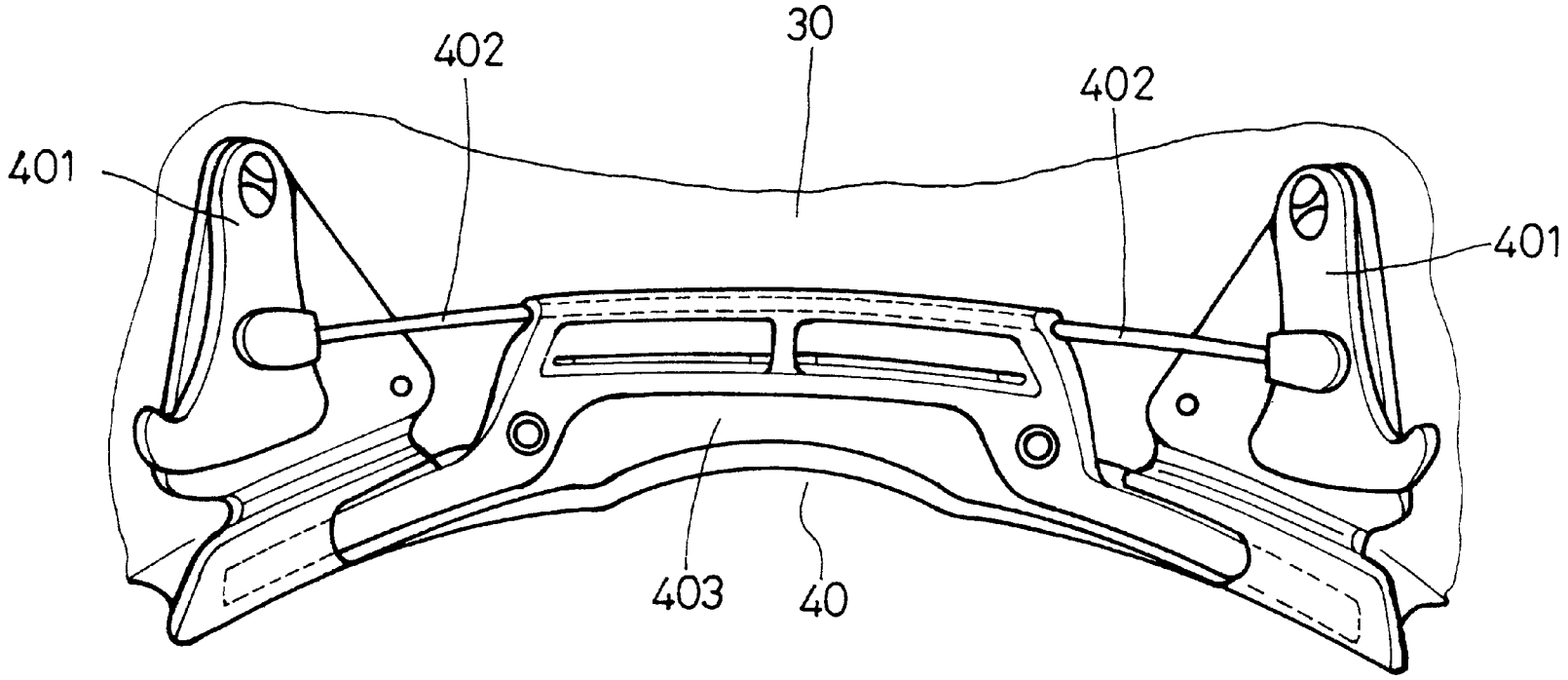
FIG. 2 (PRIOR ART)
FIG. 2 is schematic view showing the rear of a chin protector of a compound protective helmet of the prior art.
Figure 4:
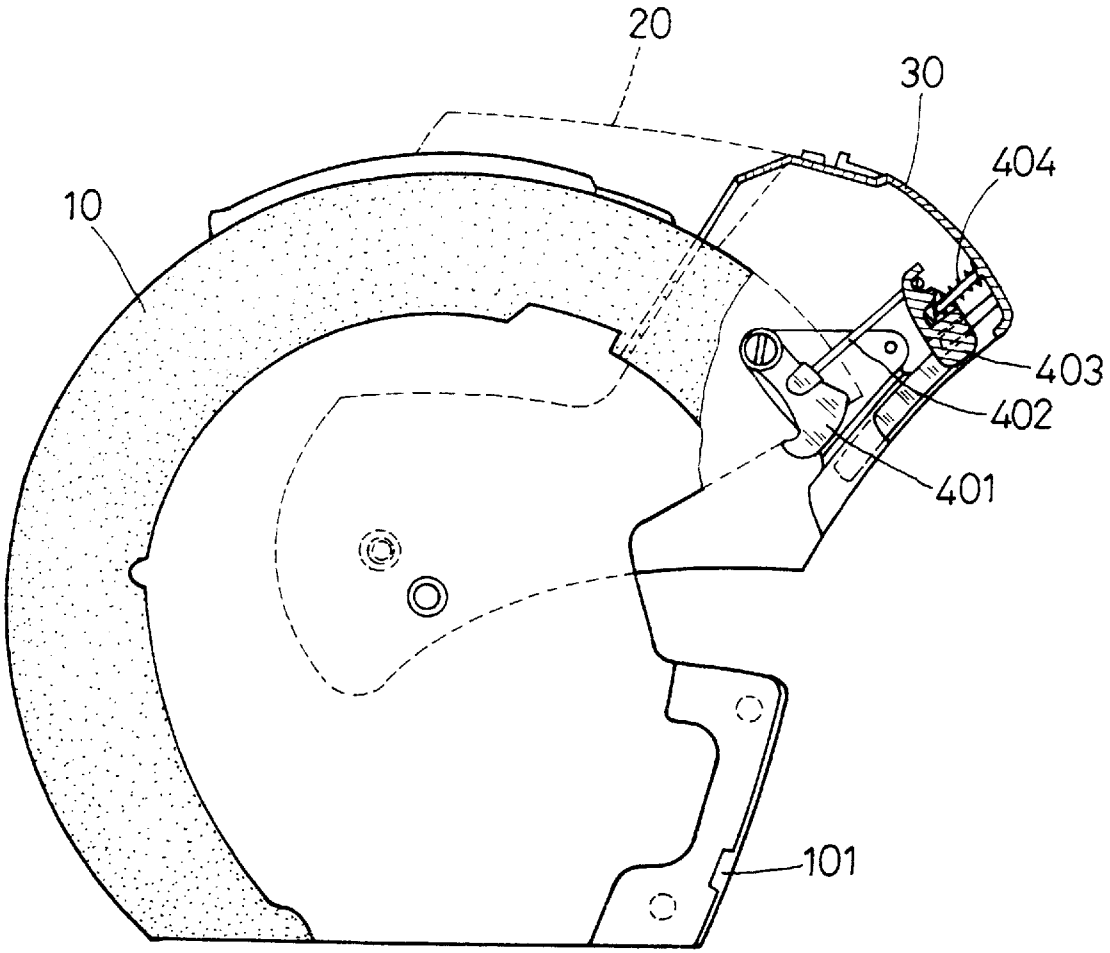
FIG. 4 (PRIOR ART)
FIG. 4 is a sectional view of a compound, semi-mask protective helmet of the prior art.
Figure 5:
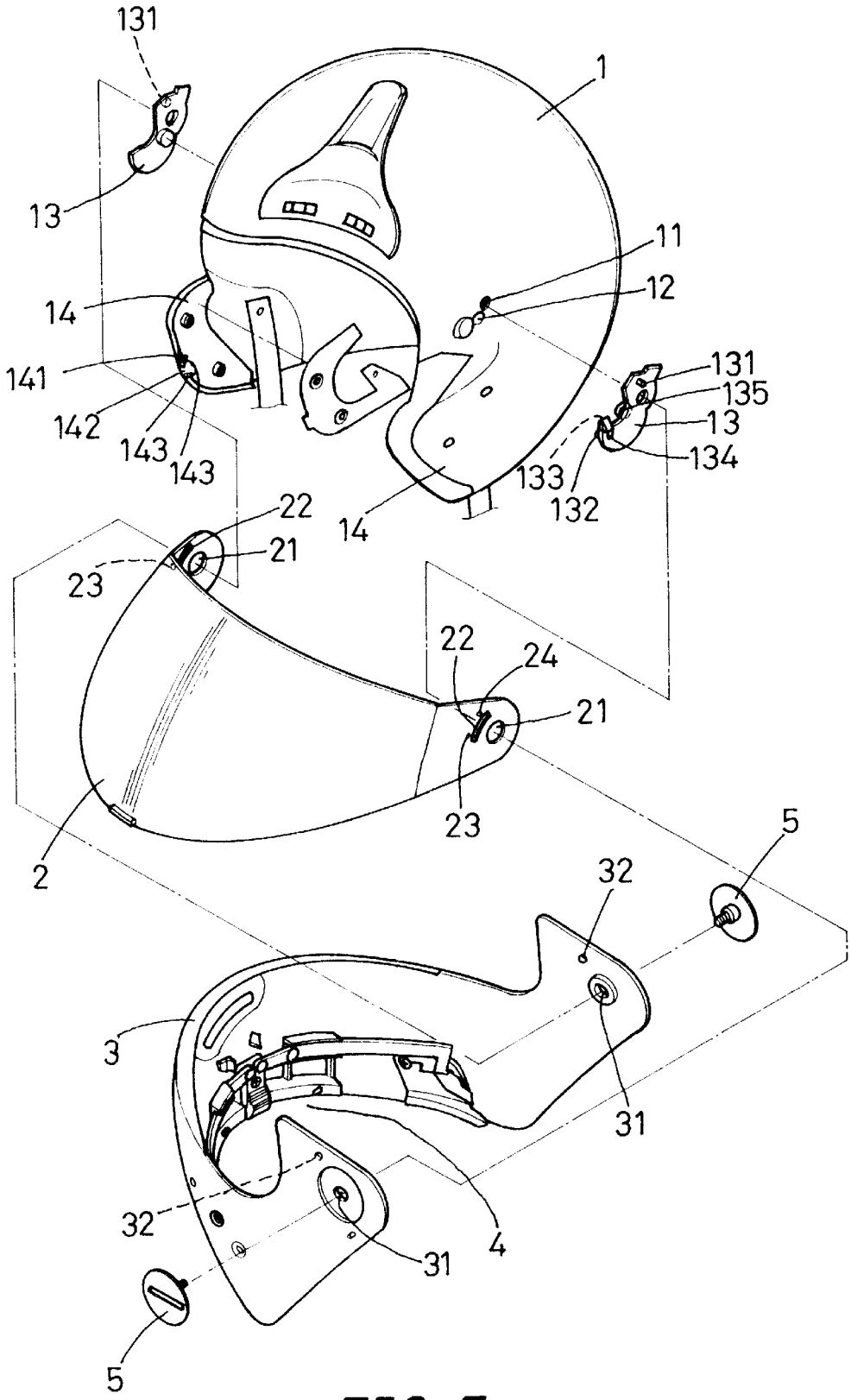
FIG. 5 is an exploded view of the present invention.

Referring to FIG. 5, the present invention comprises a bubble 1, a visor 2 pivoted to the bubble 1, and a chin protector 3. A threaded hole 11 is formed on each side of the bubble 1, and a recess 12 is provided near the threaded hole 11. A pad 13 is inserted into the recess 12. A guide post 131 protrudes from each pad 13. One of the two pads 13 includes a front and a rear nipple 132, 133. A circular recess 134 is formed at the other side of the pad 13 corresponding to the rear nipple 133. A curved portion of the pad 13 forms a guide slope 135. A guide lip 141 is provided at the front edge of both sides of the bubble 1, a groove 142 is provided below the guide lip 141, and a guide piece 143 is provided at the top and the bottom of the groove 142.

On both ends of the visor 2 at positions corresponding to the threaded holes 11 on the bubble 1 are through holes 21. An arc key hole 22 is provided at a position corresponding to the guide post 131, while front and rear positioning dents 23, 24 are provided at the front and rear ends over the arc key hole 22 at the external side of the visor 2.

Figure 6:
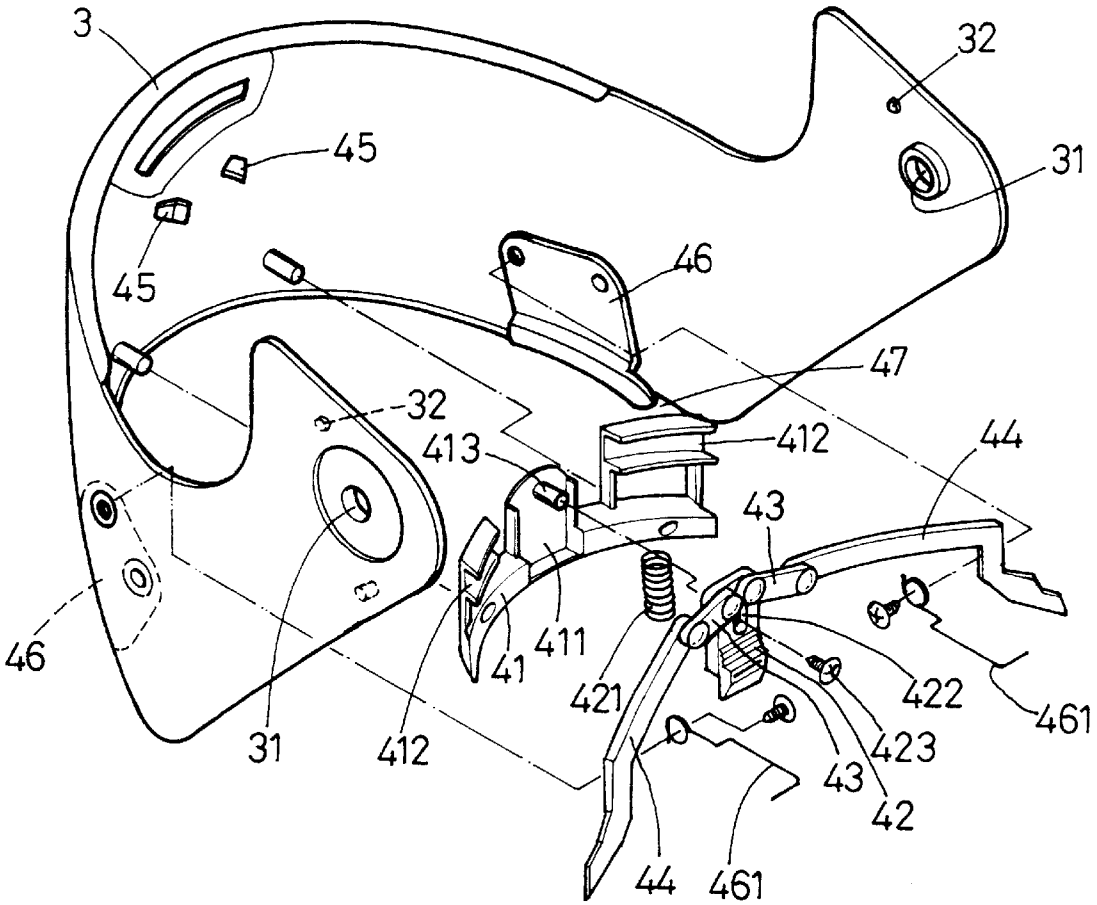
FIG. 6 is an exploded view of a chin protector of the present invention.

A securing and release device 4 is fixed inside the chin protector as illustrated in FIG. 6. The securing and release 4 is comprised of a fixing base 41 with a longitudinal sliding base 411 at its center. A lateral sliding rail 412 is provided at both sides of the fixing base 41. A threaded hole base 413 protrudes from the top of the sliding base 41. A leading block 42 is positioned on a resilient element 421. A slit 422 is provided on the leading block 42, and a screw 423 passes through the slit 422 and is received by the threaded hole base 413 so as to position the leading block 42 in the sliding base 411. The resilient element 421 is secured between the threaded base 413 and the leading block 42. One end of a pair of linkages 43 is pivoted at the top of the leading block 42, while the other end of the linkages 43 is connected to a securing lever 44 inserted into the guide rail 412. Sloped positioning blocks 45 are provided at the upper section of both linkages 43. The securing levers 44 extend backward along the chin protector 3, and are secured onto a positioning piece 46 by a bending portion formed at the end of each securing lever 44. Both of the positioning pieces are fixed with a limit piece 461 to limit the securing lever 44 so as to compromise the inner wall of the chin protector 3. A guide trough 47 with its opening facing backward is formed at the bottom edge of both the positioning pieces 46 and the chin protector 3.

Figure 7:
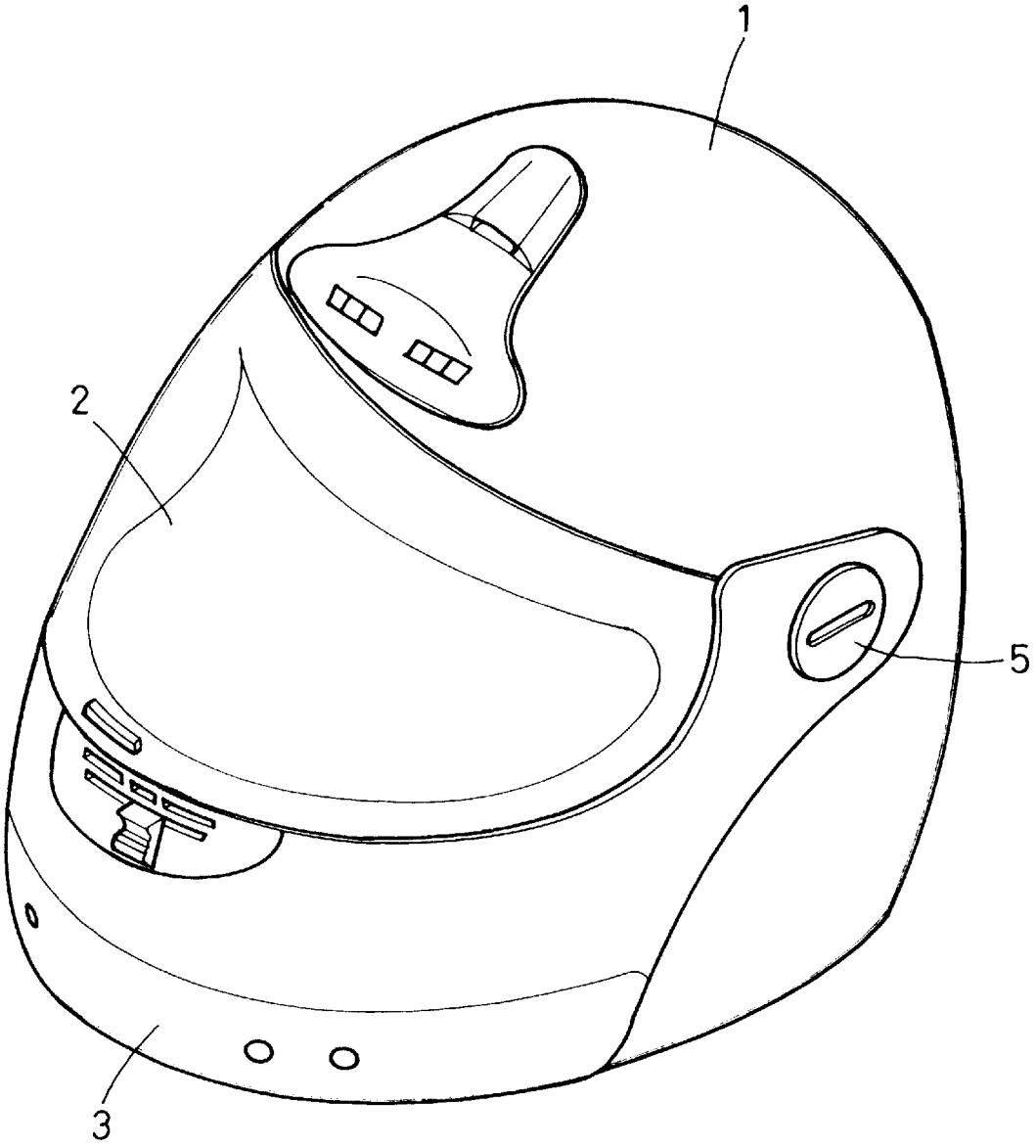
FIG. 7 is a 3D view of the helmet of the present invention.
Figure 8:
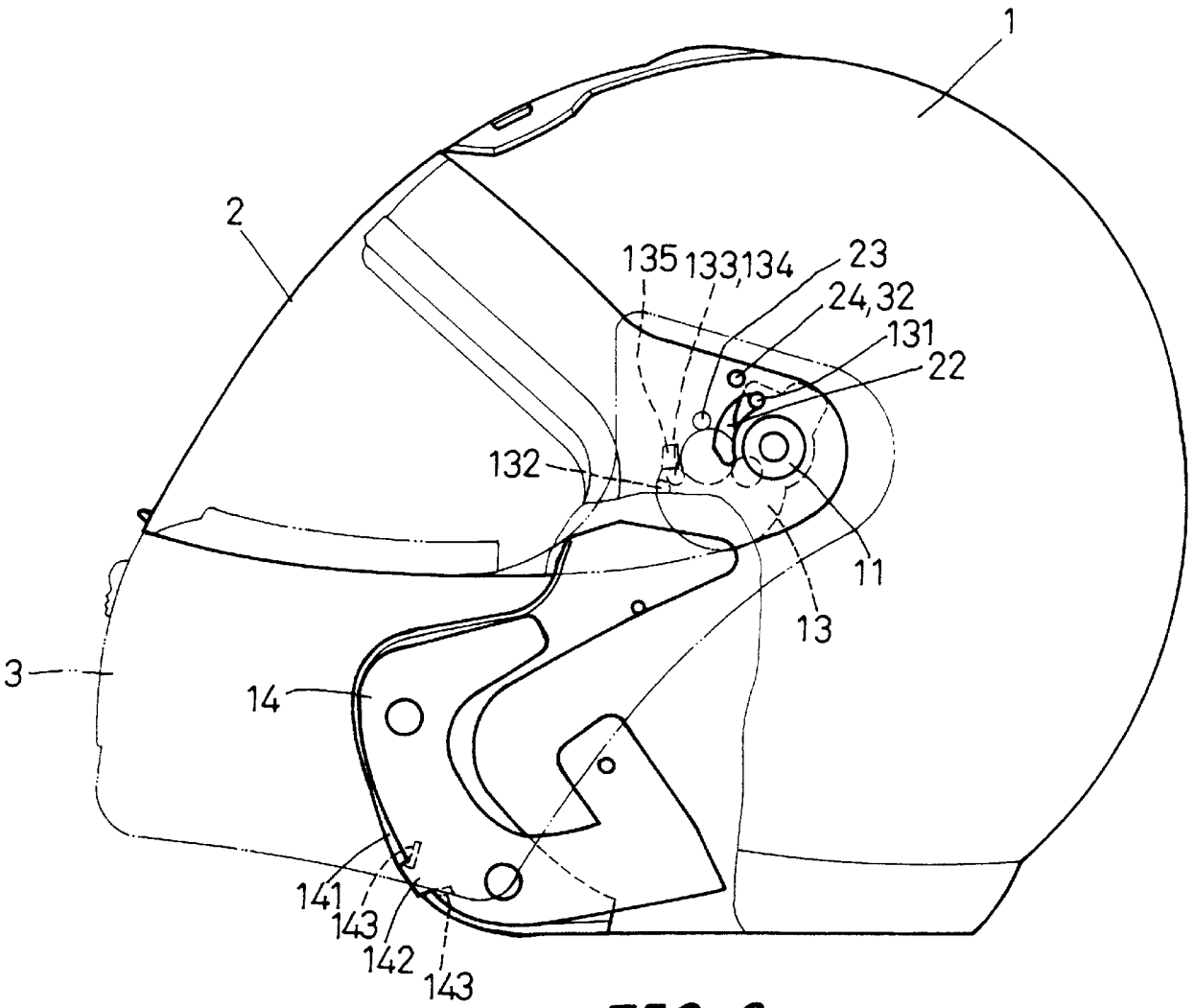
FIG. 8 is a side view showing the securing and release device of the present invention.

FIG. 7 shows the assembly of the present invention. A fastening piece 5 is provided to penetrate in sequence a pivoting hole 3 on the chin protector 3 and a through hole 21 of the visor to fix both the chin protector 3 and the visor 2 to the bubble 1. If the chin protector 3 is desired to be closed for the state of a full mask protective helmet, both securing levers 44 of the securing and release 4 are inserted into the restriction grooves 142 in the ear protector 14 at both sides of the bubble 1 while the visor 2 is also closed. The guide post 131 of the pad 13 on both sides of the bubble 1 protrudes into the terminal of the arc key hole 22 of the visor 2. The positioning nipples 32 of the chin protector 3 are received in the rear positioning dents 24 at the rear part of the visor so as to allow the visor 2 to be fully or half way lifted up as illustrated in FIG. 8. As shown in FIGS. 5 and 6, a secondary nipple 33 may be provided for additional positioning security.

Figure 9:
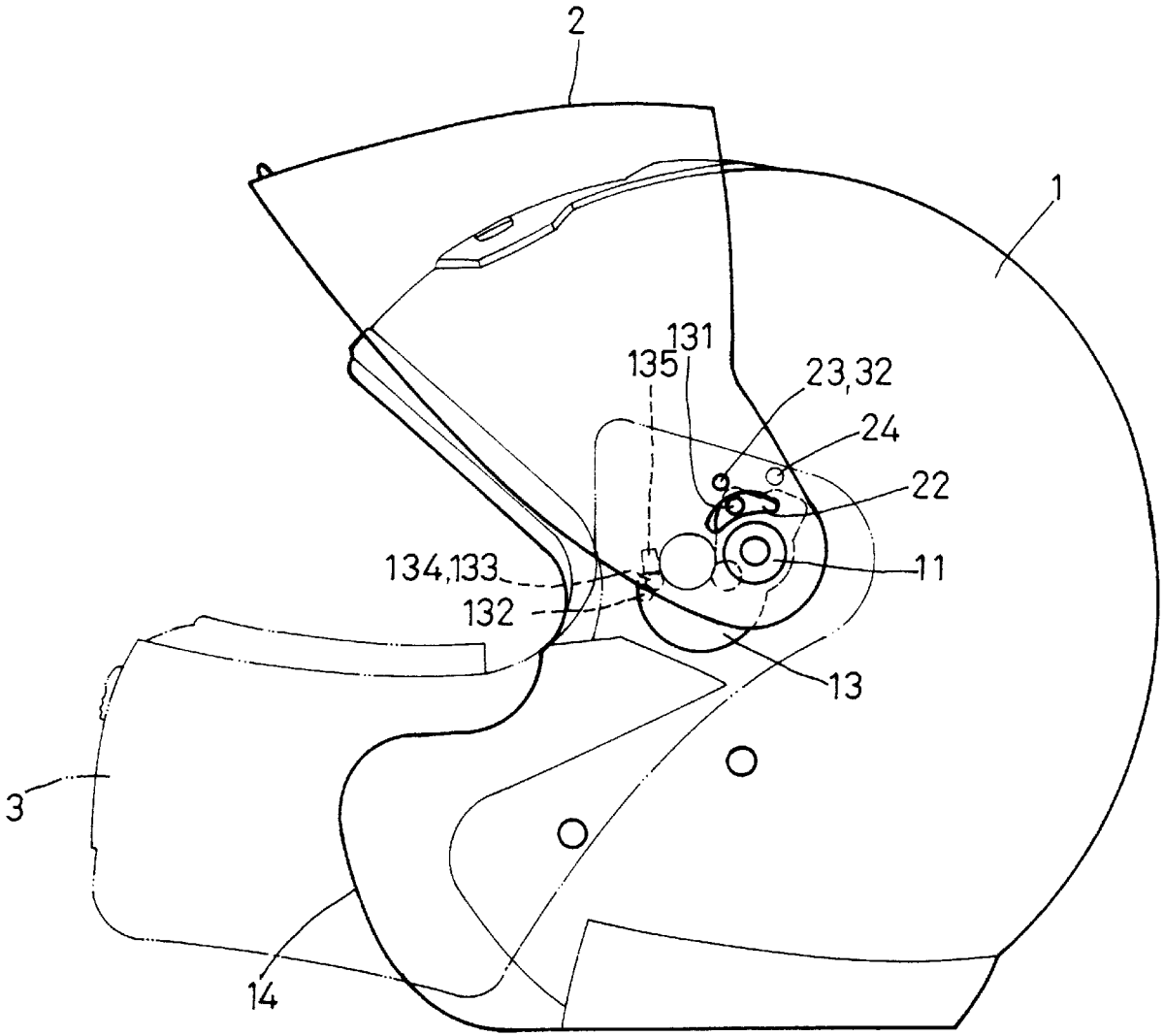
FIG. 9 is a side view showing the present invention with its visor partially pushed up.
Figure 10:
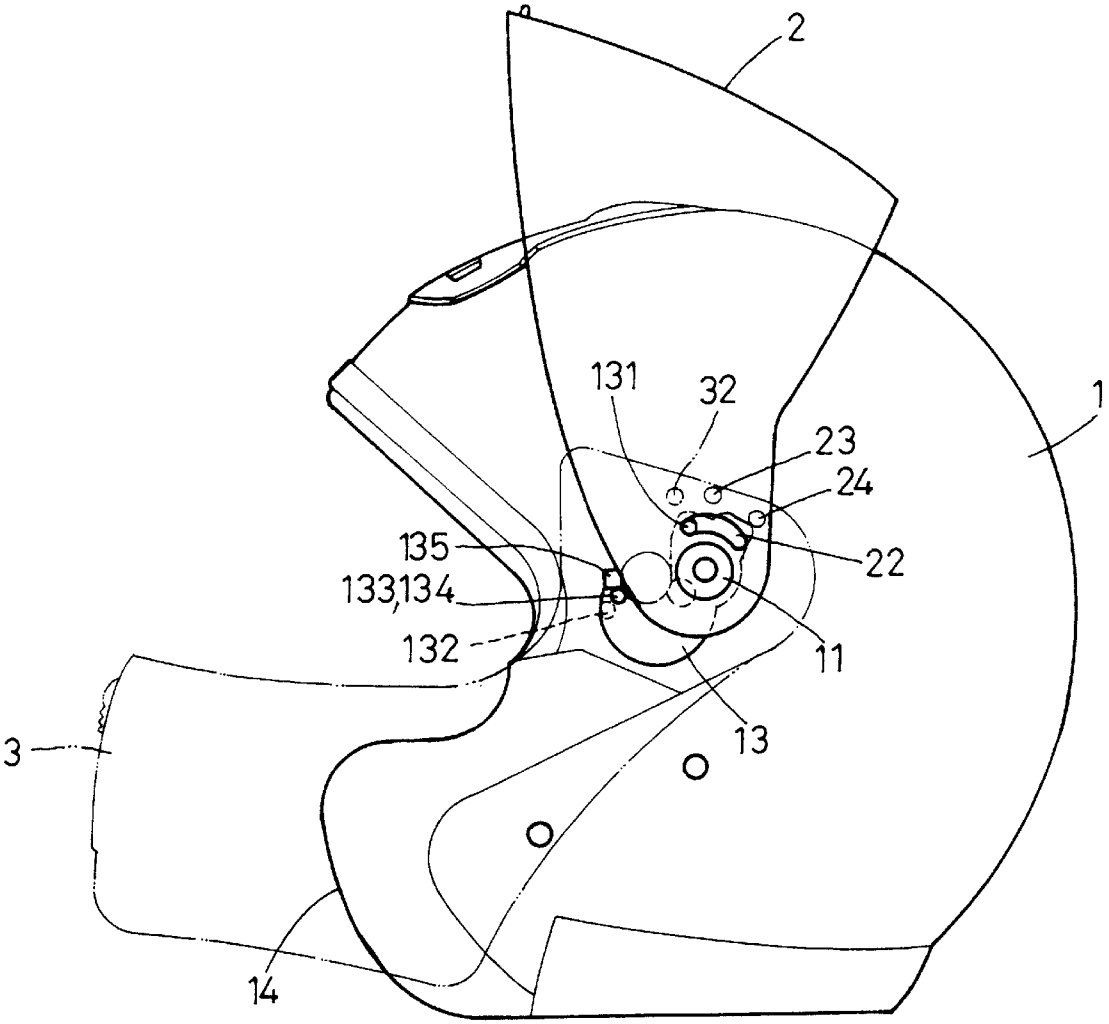
FIG. 10 is a side view showing the present invention with its visor fully pushed up.

Refer now to FIG. 9, which shows the visor 2 lifted up half way. Each of the guide posts 131 of the pad 13 is positioned in the middle section of the arc key hole 22 of the visor 2. The positioning nipples 32 of the chin protector 3 are received in the front positioning dents 23 of the visor 2. FIG. 10 shows the present invention with the visor 2 lifted all the way up. Once the visor is lifted up to its upper limit, the guide posts 131 of the pads 13 are positioned in the front end of the arc key hole 22 of the visor, and the bottom edge of the visor 2 is located on the upper side of the guide slope 135 of the pads 13. To restore the visor 2 to its halfway opened or fully closed status, the user pushes down the visor 2 so that it slides in the guide slope 135 to the positions illustrated in FIG. 8 or FIG. 9 as the case may be.

Figure 11:
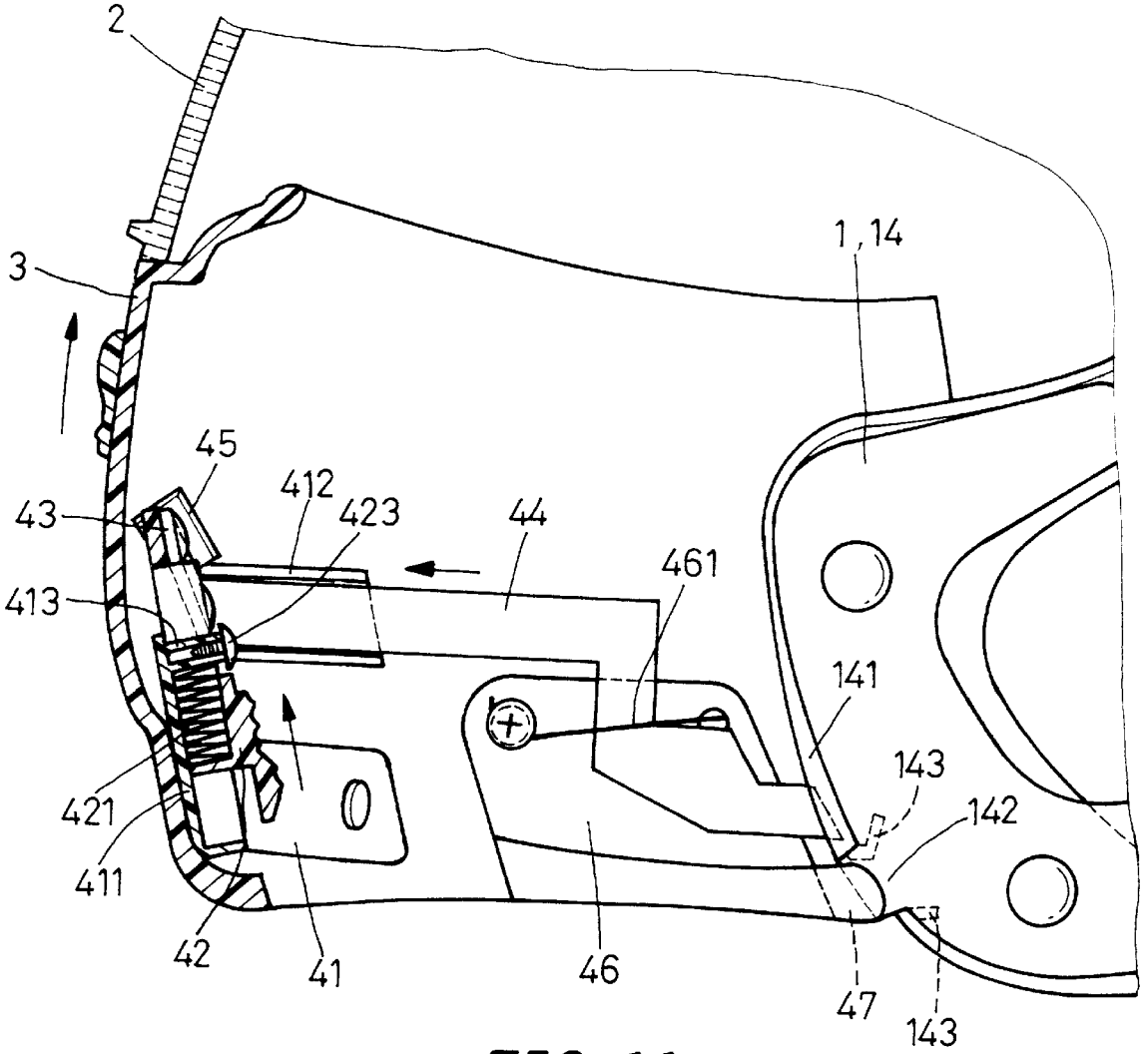
FIG. 11 is a side view showing the securing and release device of the present invention.
Figure 12:
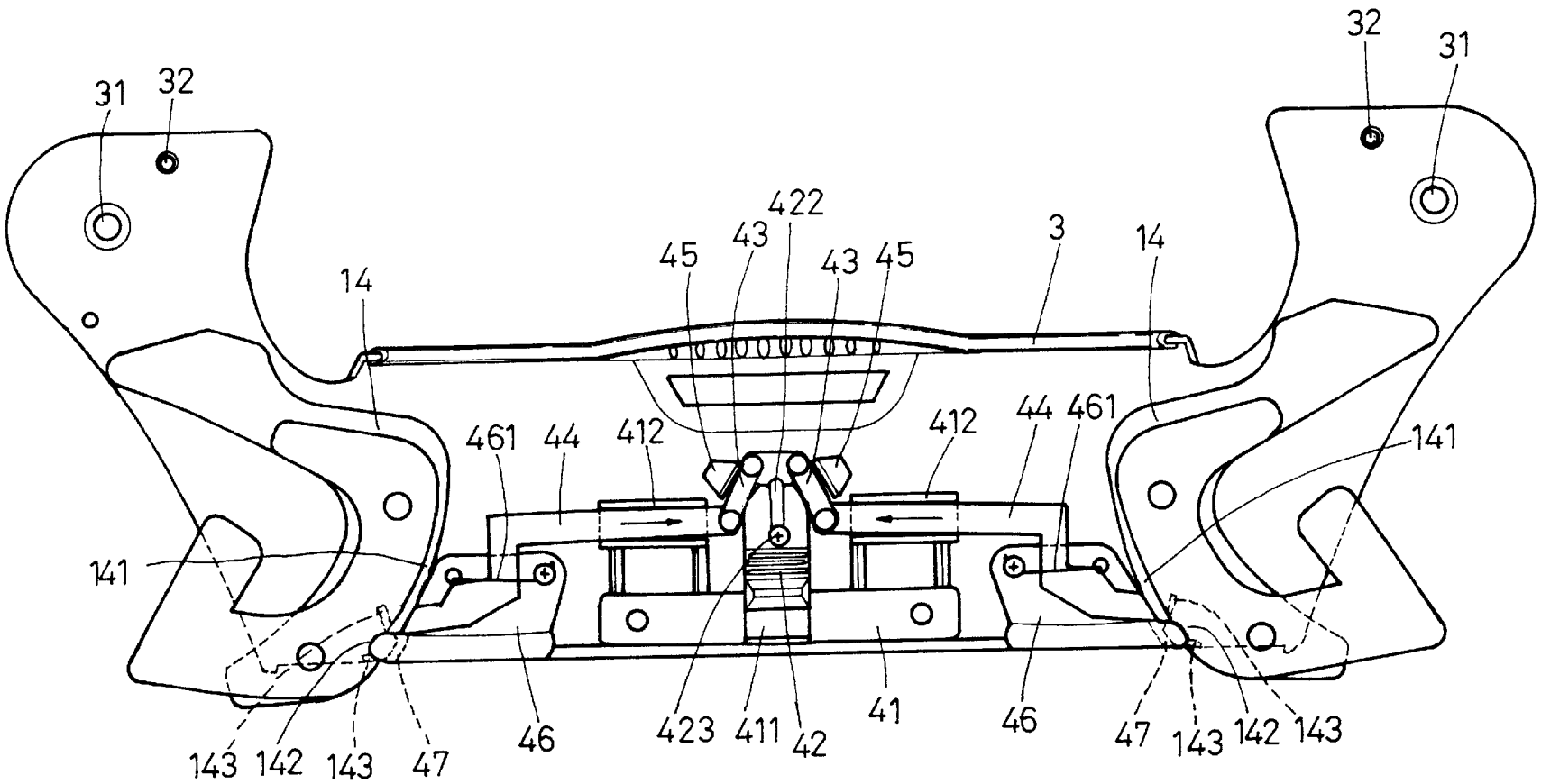
FIG. 12 is a rear view showing the securing and release device of the present invention.
Figure 13:
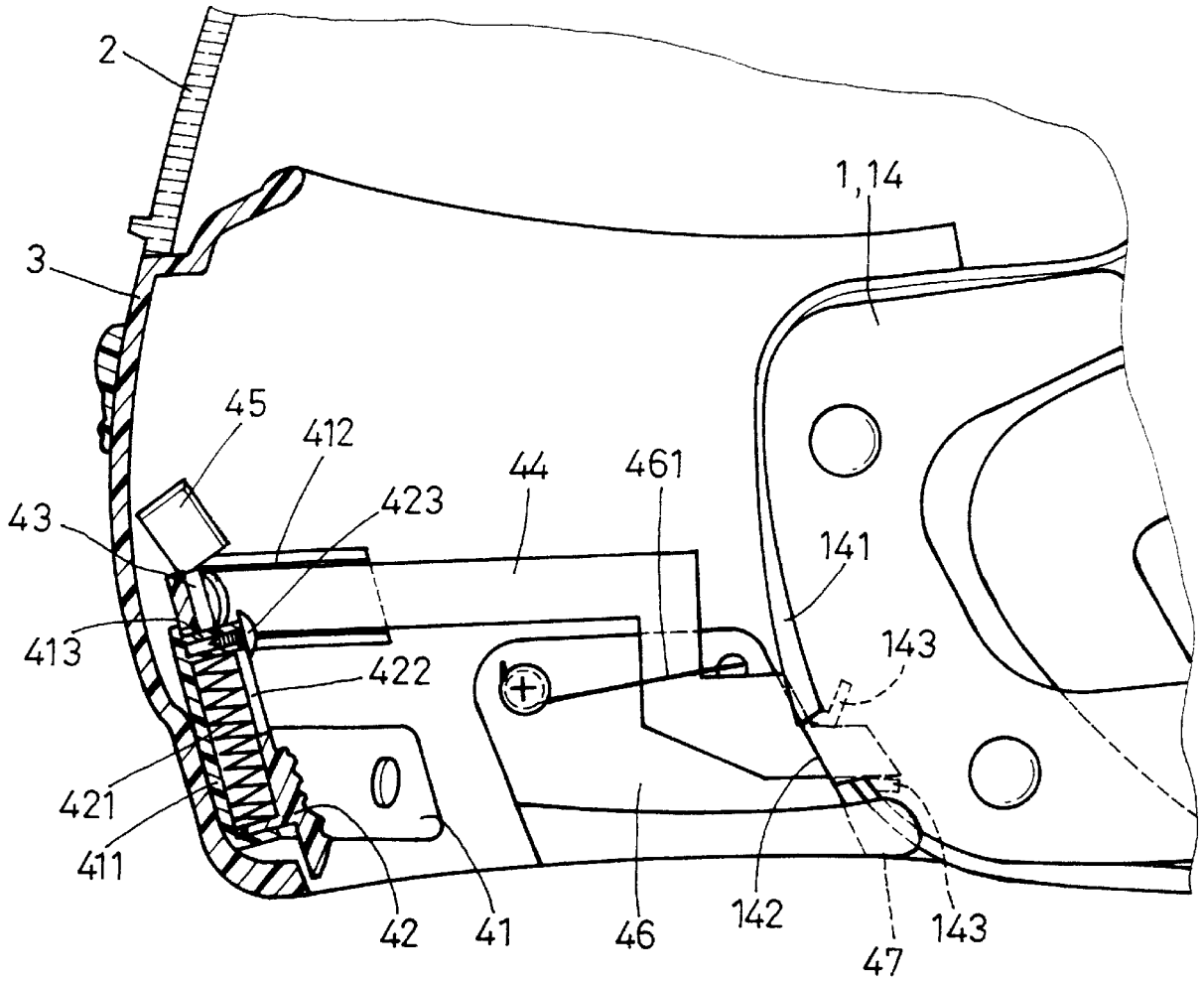
FIG. 13 is a side view of the securing and release device with the bubble closed.
Figure 14:
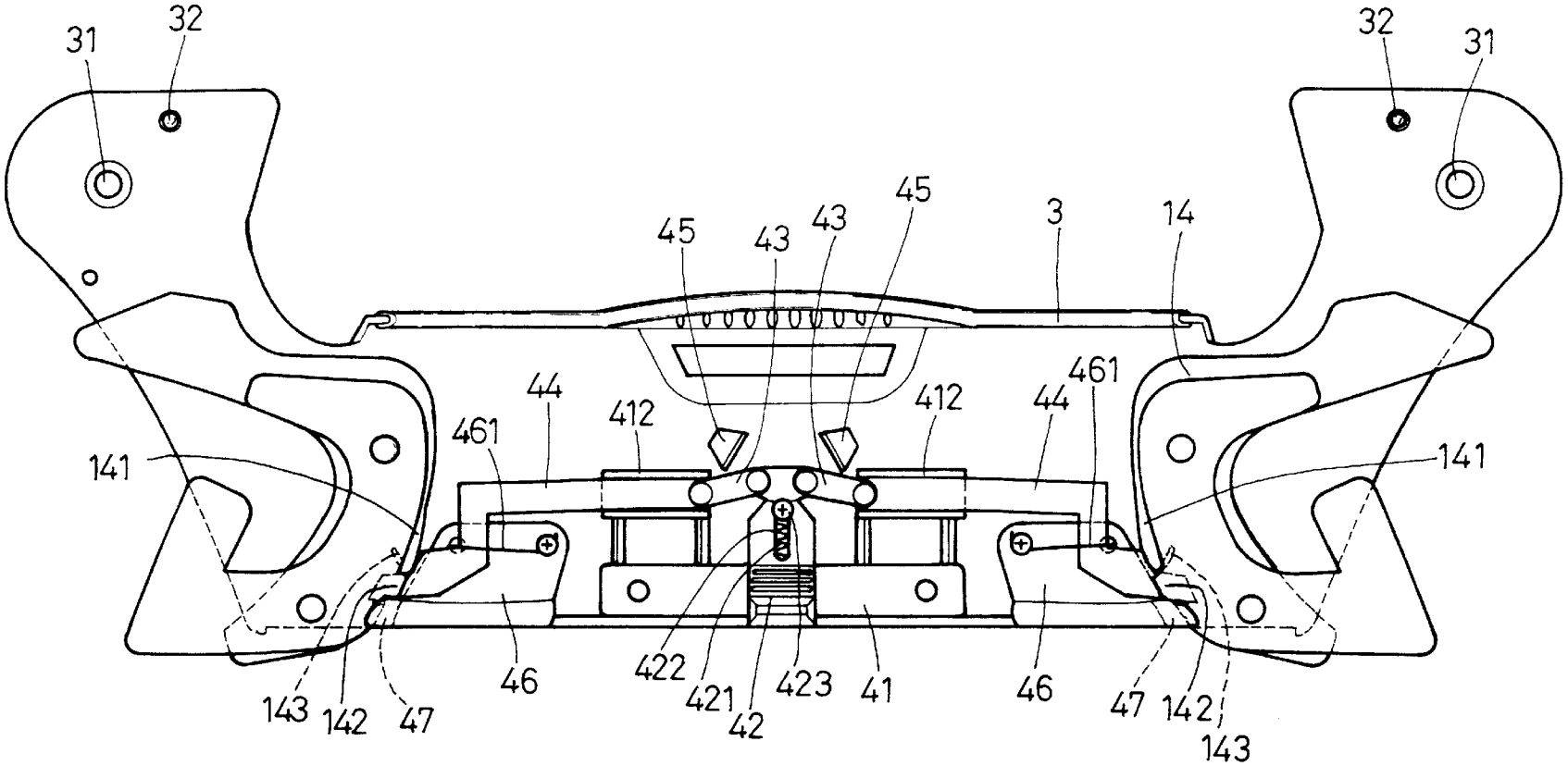
FIG. 14 is a rear view taken of the configuration of FIG. 13.

Referring to FIGS. 11 and 12, to lift up the chin protector, the user pushes up the leading block 42 to compress the resilient element 421 inside the leading block 42 while both linkages 43 are moved upward inclining toward the sloped positioning blocks 45. The other ends of the linkages 43 pull both securing levers 44 towards the fixing base 41 and retreat from the securing trough at the ear protector 14 of the bubble 1, 50 that the chin protector 3 is lifted up until the securing nipples are secured at the circular recess 134 outside the pad 13. In the meantime, both front and rear nipples 132 and 133 of the pad 13 are pressing against the external side of the bubble 1 to provide two supports for the chin protector to secure in the position of halfway open. To restore to the full mask status, the user just pulls down the chin protector 3 so that the ends of both securing levers 44 slide along the ear protector of the bubble 1 and move through the guide lip 141. The ear protector is guided into the restriction trough 142 by the guide groove 47 formed by the chin protector and the positioning piece 46. The resilient element 421 is restored and both securing levers are received in the restriction trough 142 as illustrated in FIGS. 13 and 14, that is, returned to the status as shown in FIG. 8.

The present invention allows the following advantages:

1. The visor may be lifted halfway or all the way up as desired by the user.

2. The securing and release device operates by inserting its securing levers into position and effectively prevents inadvertent release.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A compound protective helmet, comprising:

a bubble with a pair of pads fixed on opposing sides of said bubble, each said pad comprises a protruding positioning guide post, said bubble further comprises a restriction trough provided at each of two ear protectors of said bubble, a visor pivotally attached to said bubble, said visor comprises a pair of arc key holes formed at locations corresponding to locations of said positioning guide posts of said pad, a positioning dent is recessed in an external side of each said arc key hole, a chin protector pivotally attached to said bubble, positioning nipples are provided on said chin protector at locations corresponding to those of said positioning dents of said visor, and a securing and release device fixed to said chin protector, said securing and release device comprises a fixing base with a longitudinal sliding base, a lateral sliding rail provided at both sides of said fixing base, a resilient leading block, and a pair of linkages, a first end of said linkages is pivotally attached at a top end of said leading block, and a second end of said linkages is pivotally attached to a respective one of a pair of securing levers, said securing levers being positioned in said sliding rail; wherein said visor is lifted with said positioning guide posts traveling in said arc key holes, said visor is held in a desired position by said positioning dents and said positioning nipples, said securing and release device allows a user to position said helmet in a full mask position when the user pulls said mask down so that said resilient leading block pushes said securing levers into said restriction trough of said ear protector of said bubble, and when said securing levers are disengaged from said restriction trough, said chin protector can be lifted by the user.

2. A compound protective helmet as claimed in claim 1, wherein:

a top end of said sliding base is formed as a threaded hole base, a resilient element is inserted in said leading block, said leading block is provided with a slit for a bolt to penetrate through and be received in said threaded hole base while said resilient element is secured between said leading block and said threaded hole.

3. A compound protective helmet as claimed in claim 1, wherein:

said fixing base of said securing and release device is fixed at tops of two slope positioning blocks to push against said leading block and said linkages.

4. A compound protective helmet as claimed in claim 1, wherein:

a positioning piece is respectively fixed at both sides of said fixing base of said securing and release device, and a limit piece is provided on said positioning piece to limit travel of said securing levers.

5. A compound protective helmet as claimed in claim 1, wherein:

at a hook part of one of said pads, a guide slope is formed on a side of said pad, such that when said visor is lowered, said visor slides along said guide slope.

6. A compound protective helmet as claimed in claim 1, wherein:

a guide lip protruding over said restriction trough is provided in said ear protector of said bubble for guiding said securing levers.

7. A compound protective helmet as claimed in claim 1, wherein:

said ear protectors of said bubble are each provided with guide pieces at top and bottom ends inside said restriction trough for guiding said securing levers.

* * * * *